US007644767B2

(12) United States Patent
Kalb et al.

(10) Patent No.: US 7,644,767 B2
(45) Date of Patent: Jan. 12, 2010

(54) SAFETY VALVE WITH FLAPPER/FLOW TUBE FRICTION REDUCER

(75) Inventors: Frank D. Kalb, Trophy Club, TX (US); Jimmie R. Williamson, Jr., Carrollton, TX (US); James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 138 days.

(21) Appl. No.: 11/619,150

(22) Filed: Jan. 2, 2007

(65) Prior Publication Data

US 2008/0156497 A1 Jul. 3, 2008

(51) Int. Cl.
*E21B 34/06* (2006.01)

(52) U.S. Cl. ..... 166/332.8; 166/332.1

(58) Field of Classification Search ..... 166/332.8, 166/319, 332.1, 321; 137/315.16
See application file for complete search history.

(56) References Cited

U.S. PATENT DOCUMENTS

| | | | | |
|---|---|---|---|---|
| 3,036,590 | A * | 5/1962 | Knox | 137/315.02 |
| 4,706,933 | A | 11/1987 | Sukup et al. | |
| 4,729,432 | A * | 3/1988 | Helms | 166/317 |
| 4,919,205 | A | 4/1990 | Dollison | |
| 5,095,994 | A * | 3/1992 | Dollison | 166/386 |
| 5,636,661 | A * | 6/1997 | Moyes | 137/614.2 |
| 6,227,299 | B1 | 5/2001 | Dennistoun | |
| 6,253,843 | B1 * | 7/2001 | Rawson et al. | 166/66.7 |
| 6,321,842 | B1 * | 11/2001 | Pringle et al. | 166/313 |
| 6,394,187 | B1 * | 5/2002 | Dickson et al. | 166/383 |
| 6,957,703 | B2 * | 10/2005 | Trott et al. | 166/332.8 |
| 6,991,040 | B2 * | 1/2006 | Hill et al. | 166/373 |
| 7,021,386 | B2 | 4/2006 | Vick, Jr. et al. | |
| 2004/0007365 | A1 * | 1/2004 | Hill et al. | 166/386 |
| 2007/0095406 | A1 * | 5/2007 | Colton et al. | 137/553 |

OTHER PUBLICATIONS

Drawing of typical prior art subsurface safety valve seat, undated.
International Search Report and Written Opinion issued for International Patent Application No. PCT/US2007/088908 dated Jun. 10, 2008 (9 pages).

* cited by examiner

*Primary Examiner*—Shane Bomar
(74) *Attorney, Agent, or Firm*—Marlin R. Smith

(57) ABSTRACT

A safety valve with a flapper/flow tube friction reducer. A safety valve for use in a subterranean well includes a closure assembly, an operating member which engages the closure assembly, and at least one of the closure assembly and the operating member including a friction reducing device which provides rolling contact between the closure assembly and the operating member. Another safety valve includes a flapper which rotates about a pivot relative to a seat, a flow tube which engages the flapper to rotate the flapper, and a friction reducing device which with rolling contact biases the flow tube toward the pivot when the flow tube engages the flapper. Yet another safety valve is described in which at least one of the flapper, the seat and the flow tube has a friction reducing device attached thereto which provides rolling contact between the flapper and the flow tube, or between the flow tube and the seat.

21 Claims, 5 Drawing Sheets

SAFETY VALVE WITH FLAPPER/FLOW TUBE FRICTION REDUCER

BACKGROUND

The present invention relates generally to equipment utilized and operations performed in conjunction with a subterranean well and, in an embodiment described herein, more particularly provides a safety valve with a flapper/flow tube friction reducer.

In a typical safety valve, a flow tube or opening prong is displaced relative to a flapper in order to open or close a production flow passage formed through the safety valve. In many instances, sand and other debris is produced through the flow passage, which causes dramatically increased friction in operation of the safety valve.

To counteract this increased friction, manufacturers of safety valves have generally attempted to increase the force used to displace the flow tube. Unfortunately, this solution has only limited effectiveness and applicability.

In the case of hydraulically operated safety valves, piston area is limited, increased pressure ratings for hydraulic conduits and pumps are expensive and sometimes unavailable, and available operating pressure differential is severely limited for deep set safety valves. Similar limitations are present for other types of safety valves (such as electrically, magnetically, etc. operated safety valves).

Even when sand and other debris is not being produced through a safety valve, damage can be caused when friction delays displacement of the flow tube during what is known as a "slam closure" of the safety valve. Increased friction due to sand and other debris makes this damage more likely.

SUMMARY

In carrying out the principles of the present invention, a safety valve is provided which solves at least one problem in the art. One example is described below in which a friction reducing device is used to minimize friction between a flow tube and a seat of a safety valve. Another example is described below in which a friction reducing device is used to minimize friction between a flow tube and a flapper of a safety valve.

In one aspect of the invention, a safety valve for use in a subterranean well is provided. The safety valve includes a closure assembly and an operating member which engages the closure assembly. At least one of the closure assembly and the operating member includes a friction reducing device which provides rolling contact between the closure assembly and the operating member.

In another aspect of the invention, a safety valve includes a flapper which rotates about a pivot relative to a seat. A flow tube engages the flapper to rotate the flapper. A friction reducing device uses rolling contact to bias the flow tube toward the pivot when the flow tube engages the flapper.

In yet another aspect of the invention, a safety valve is provided in which at least one of the flapper, the seat and the flow tube has a friction reducing device attached thereto which provides rolling contact between the flapper and the flow tube, or between the flow tube and the seat. The friction reducing device may include a roller attached to the flapper, a roller attached to the seat and/or a roller attached to the flow tube, etc.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
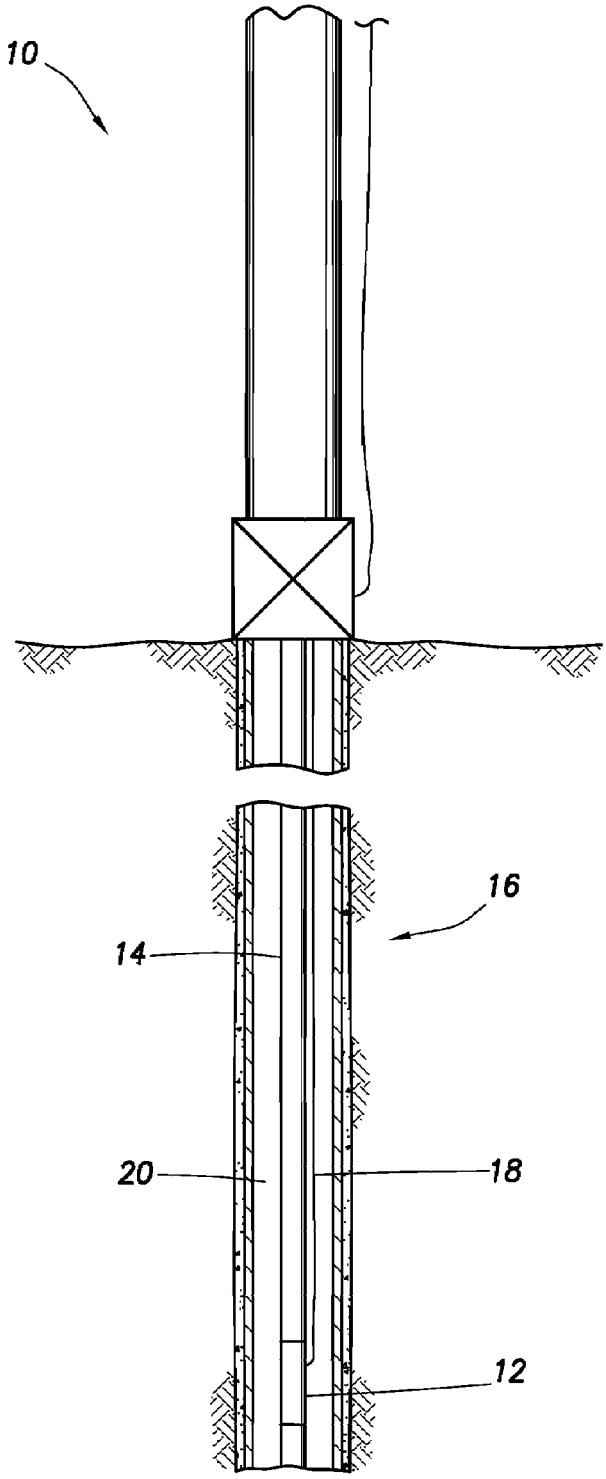
FIG. 1 is a schematic partially cross-sectional view of a well system embodying principles of the present invention.

Representatively illustrated in FIG. 1 is a well system 10 which embodies principles of the present invention. A safety valve 12 is interconnected in a tubular string 14 as part of a production assembly 16 positioned in a wellbore 20. A line 18 is used to control operation of the safety valve 12 from a remote location, such as the earth's surface.

The line 18 may be a hydraulic, electrical, optical, or other type or combination of line(s). Alternatively, operation of the safety valve 12 may be controlled from the remote location using telemetry, such as electromagnetic, acoustic, pressure pulse, or other type of telemetry, in which case the line 18 may not be used.

The safety valve 12 is used to selectively permit and prevent flow of fluid through a flow passage 22 (not visible in FIG. 1, see FIG. 3) of the tubular string 14 which extends through the safety valve. Specifically, in emergency situations the safety valve 12 is used to close off the passage 22 and thereby prevent uncontrolled flow of hydrocarbons to the surface via the tubular string 14.

However, it should be clearly understood that the well system 10 as depicted in FIG. 1 and described herein is only one of the many applications for the principles of the present invention. A large variety of different well systems and other applications may incorporate the principles of the invention, and so it will be appreciated that the invention is not limited in any respect to the details of the well system 10.

Figure 2:
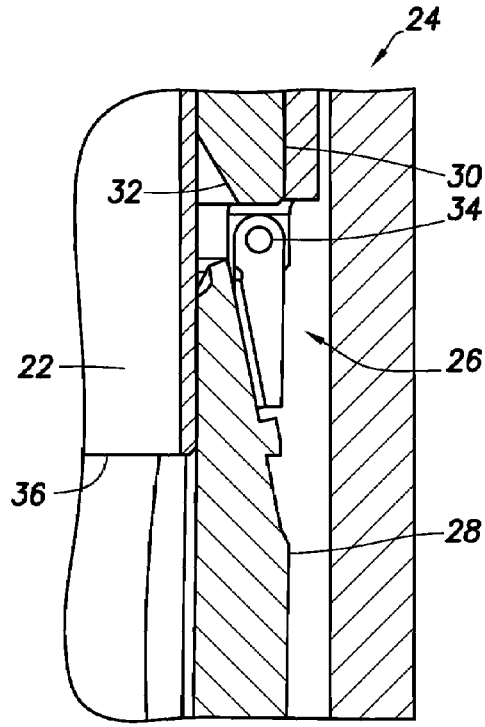
FIG. 2 (PRIOR ART)
FIG. 2 is an enlarged scale cross-sectional view of a prior art safety valve construction.

Referring additionally now to FIG. 2, an enlarged scale cross-sectional view of a portion of a prior art safety valve 24 is schematically illustrated. In this view it may be seen that the safety valve 24 includes a closure assembly 26 for selectively closing off flow through the passage 22.

The closure assembly 26 includes a flapper 28 and a seat 30. The flapper 28 rotates about a pivot 34 and engages a sealing surface 32 of the seat 30 to prevent flow through the passage 22.

As shown in FIG. 2, the flapper 28 is pivoted downwardly away from the seat 30 by a flow tube 36 (also known as an opening prong) in order to permit flow through the passage 22. A lower end of the flow tube 36 engages the flapper 28 and rotates the flapper downward about the pivot 34 as the flow tube displaces downward.

To close the safety valve 24, the flow tube 36 is displaced upwardly into the seat 30, thereby allowing the flapper 28 to pivot upward and engage the sealing surface 32. A torsion spring (not shown) assists in this upward pivoting of the flapper 28. However, if there is upward flow of fluid through the passage 22, a resulting pressure differential across the flapper 28 will cause it to pivot upwardly, in large part without the assistance of the spring.

During normal production operations, the flow tube 36 maintains the flapper 28 in its downwardly pivoted position as shown in FIG. 2, with the flow tube being displaced further downward so that the flapper is completely or partially isolated by the flow tube from the flow of fluid in the passage 22. Nevertheless, sand and other debris can enter the spaces between the flow tube 36 and the flapper 28 and seat 30, whether during production flow and/or during opening and closing of the safety valve 24.

This sand and other debris increases the friction which resists displacement of the flow tube 36 relative to the seat 30 and flapper 28. One consequence of this is that greater force is needed to displace the flow tube 36.

Another consequence is that displacement of the flow tube 36 is impeded and delayed, so that the flow tube is not able to displace quickly enough in a slam closure. This increases the amount of time the lower end of the flow tube 36 contacts the flapper 28 near the pivot 34, which is a high stress situation (due at least to the pressure differential across the flapper and the resulting torque about the pivot 34), and which sometimes leads to shearing of the pivot and/or damage to other components.

Figure 3:
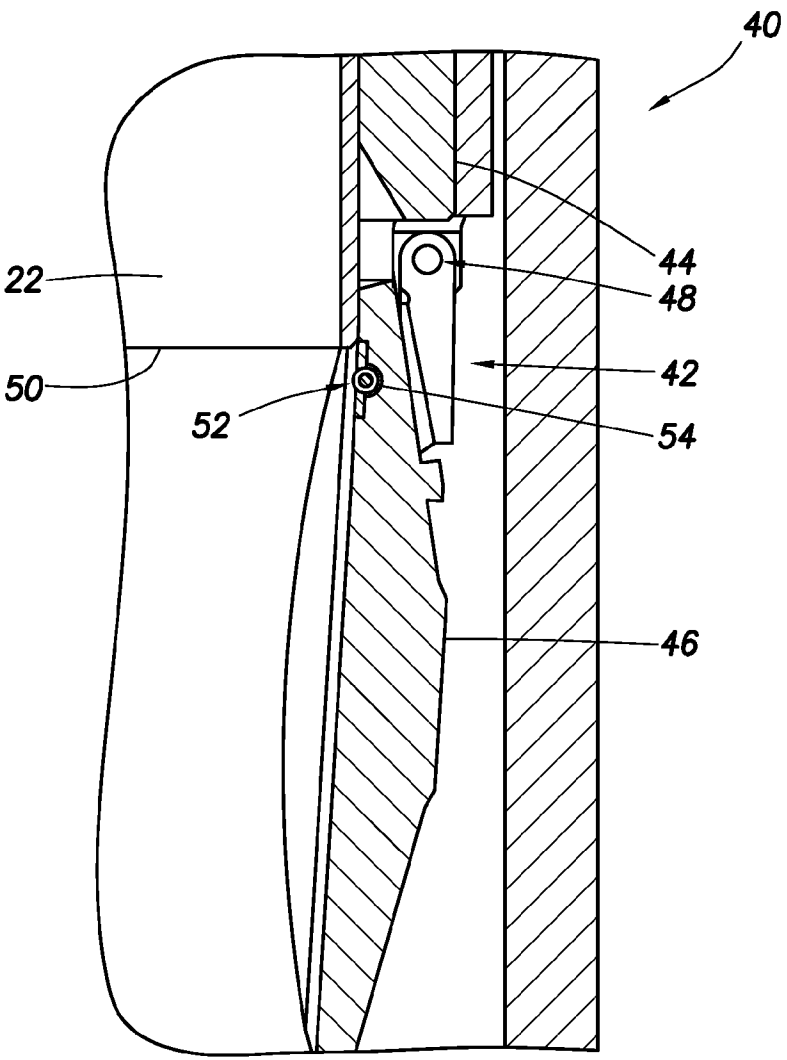
FIG. 3 is a schematic cross-sectional view of a safety valve usable in the well system of FIG. 1 and embodying principles of the present invention.

Referring additionally now to FIG. 3, a cross-sectional view of a portion of a safety valve 40 embodying principles of the present invention is representatively illustrated. The safety valve 40 is similar in some respects to the prior art safety valve 24 described above, however, the safety valve 40 includes improvements which address the problems of increased friction due to sand or debris in the prior art safety valve.

The safety valve 40 includes a closure assembly 42 with a seat 44, closure member 46 and pivot 48. The closure member 46 is illustrated in FIG. 3 as a flapper (similar to the flapper 28 of the safety valve 24 described above), but other types of closure members (such as a ball, gate, etc.) may be used if desired.

Downward displacement of an operating member 50 is used to displace the closure member 46 and permit flow through the passage 22, and upward displacement of the operating member is used to displace the closure member and prevent flow through the passage 22. The operating member 50 is illustrated in FIG. 3 as a flow tube (similar to the flow tube 36 of the safety valve 24 described above), but other types of operating members may be used if desired.

The closure assembly 42 further includes a friction reducing device 52 attached to the closure member 46. As depicted in FIG. 3, the friction reducing device 52 includes a roller 54 which contacts the operating member 50 when the operating member is displaced downwardly relative to the closure member 46.

The roller 54 provides rolling contact between the closure member 46 and the operating member 50, thereby reducing friction between these components. It will be readily appreciated by those skilled in the art that this rolling contact produces far less friction between the closure member 46 and the operating member 50 in the presence of sand and debris, as compared to the sliding contact between these components in the prior art safety valve 24.

Although only one friction reducing device 52 including only one roller 54 is depicted in FIG. 3, any number of friction reducing devices or rollers may be used in keeping with the principles of the invention. In addition, although the rolling contact between the closure assembly 42 and operating member 50 is depicted as being provided by the roller 54, other components (such as balls, etc.) may be used to provide rolling contact in other embodiments.

Figure 4:
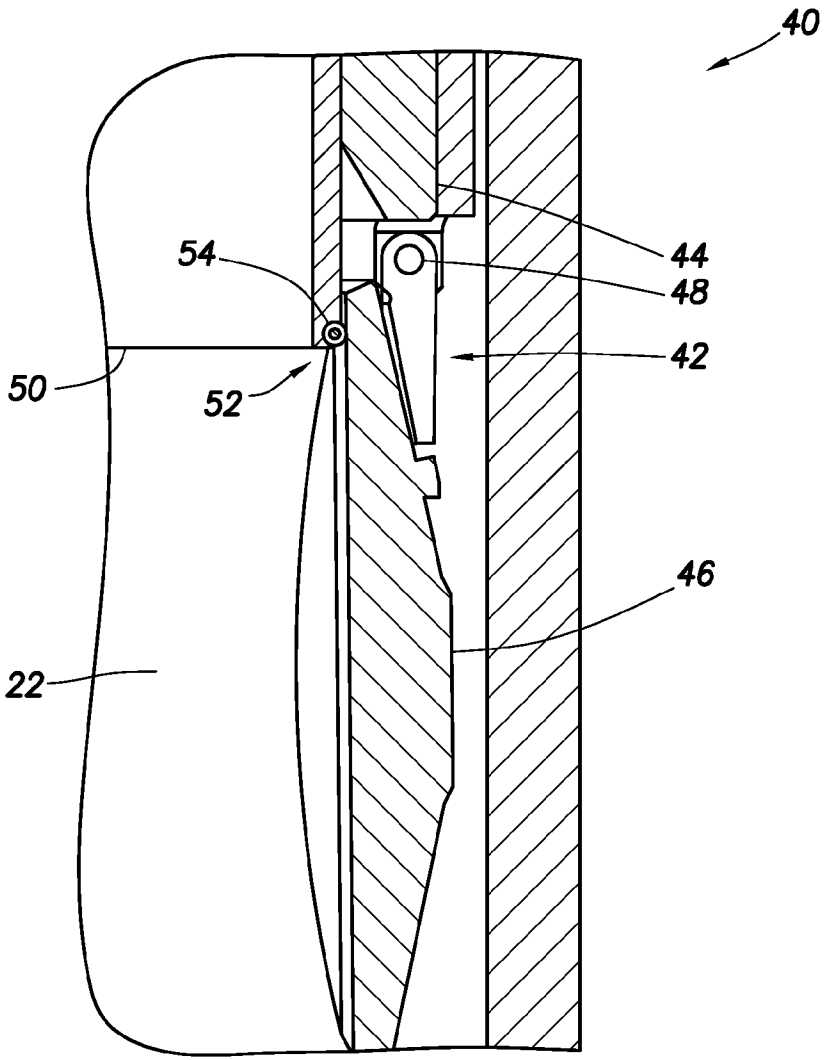
FIG. 4 is a schematic cross-sectional view of a first alternate configuration of the safety valve.

Referring additionally now to FIG. 4, an alternate configuration of the safety valve 40 is representatively illustrated. This embodiment is similar in many respects to the embodiment of FIG. 3, however, in the safety valve 40 of FIG. 4, the friction reducing device 52 is attached to the operating member 50, instead of to the closure member 46.

One advantage of the configuration of FIG. 4 is that rolling contact is provided between the operating member 50 and the closure assembly 42 during the entire displacement of the operating member relative to the closure member 46. For this reason, the friction reducing device 52 is positioned at a lower end of the operating member 50.

However, any position of the friction reducing device 52 may be used in keeping with the principles of the invention. In addition, any number and any type of friction reducing device may be used in the configuration of FIG. 4. Thus, it should be clearly understood that in all of the configurations of the safety valve 40 described herein, any position, number and type of friction reducing devices may be used without departing from the principles of the invention.

Figure 5:
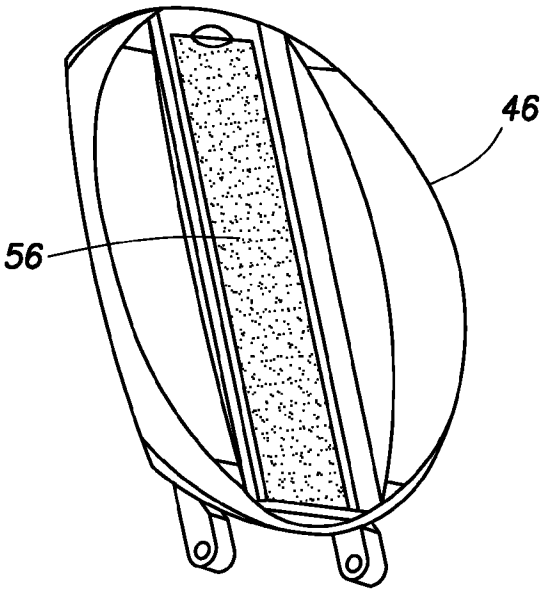
FIG. 5 is an isometric view of a closure member of a second alternate configuration of the safety valve.

Referring additionally now to FIG. 5, the closure member 46 is representatively illustrated apart from the remainder of the safety valve 40. In this view it may be seen that a friction reducing material 56 is attached to a surface of the closure member 46 where the closure member is contacted by the operating member 50.

The friction reducing material 56 may be, for example, a tungsten carbide material which is plasma bonded/sprayed onto the surface of the closure member 46. Alternatively, or in addition, the material 56 could be applied to the operating member 50, such as at a lower end and/or on an outer surface of the operating member.

The material 56 may be used on the closure member 46 and/or the operating member 50 either with or without also using the friction reducing device 52 on the closure assembly 42 or the operating member.

Figure 6:
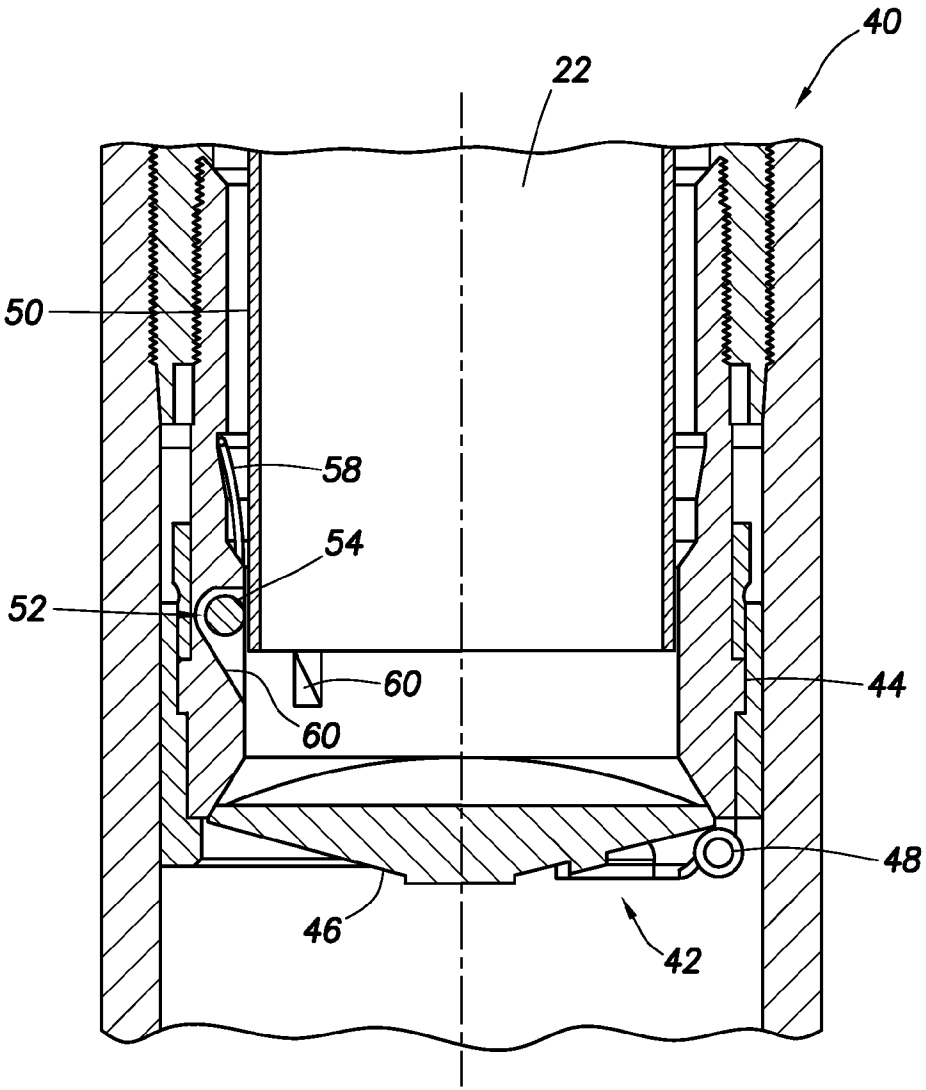
FIG. 6 is a schematic cross-sectional view of a third alternate configuration of the safety valve.

Referring additionally now to FIG. 6, another alternate configuration of the safety valve 40 is representatively illustrated. In this configuration, the friction reducing device 52 is positioned in the seat 44.

Preferably, the device 52 includes three of the rollers 54 positioned in a sidewall of the seat 44, so that the rollers extend slightly radially inward into an interior of the seat to contact the operating member 50. The rollers 54 are maintained in position by retaining clips 58, which are described more fully below.

A tapered recess 60 is formed in the seat 44 below each of the rollers 54. The recesses 60 allow flushing of sand and debris from around the rollers 54 when the operating member 50 is in its upwardly displaced position as depicted in FIG. 6.

Note that the device 52 is positioned generally diametrically opposite the pivot 48 in the configuration of FIG. 6. It will be appreciated that, when the operating member 50 contacts the closure member 46 to pivot the closure member downward, or when the operating member is displaced upwardly to close the closure member, the greatest friction between the operating member and the seat is located diametrically opposite the pivot 48.

Thus, when the operating member 50 is used to rotate the closure member 46 about the pivot 48, the device 52 provides rolling contact with the operating member while biasing the operating member toward the pivot.

Figure 7:
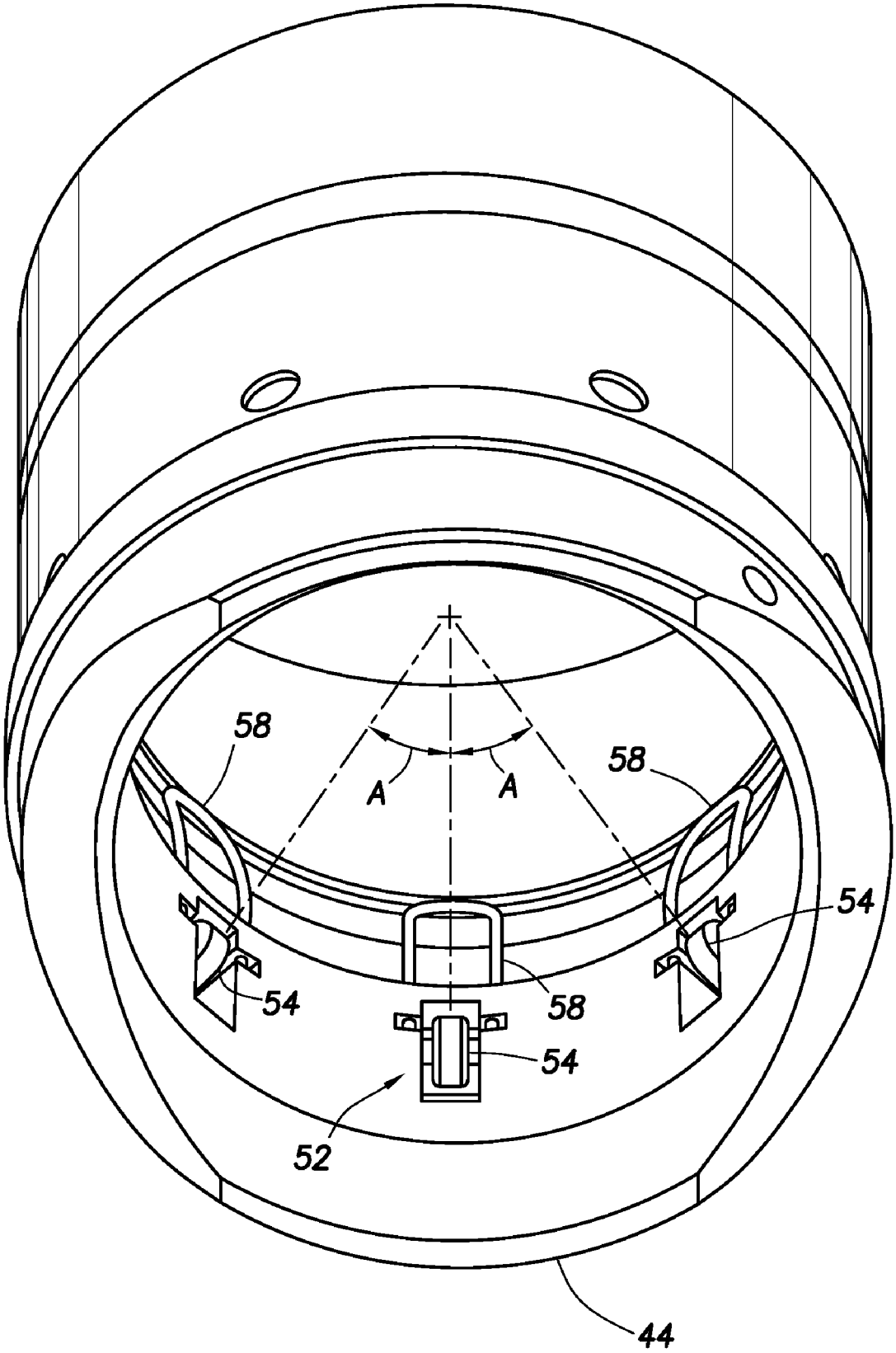
FIG. 7 is an enlarged scale isometric view of a seat assembly of the safety valve of FIG. 6.

Referring additionally now to FIG. 7, an isometric view of the seat 44 with the device 52 therein is representatively illustrated apart from the remainder of the safety valve 40. In this view, the manner in which the rollers 54 are preferably positioned in the seat 44 may be clearly seen.

The rollers 54 are preferably radially spaced apart from each other by an angle A of 45 degrees. However, other radial spacings and positions of the rollers 54 may be used if desired. For example, the rollers 54 could be axially or longitudinally spaced apart, as well as being radially spaced apart, etc.

Preferably, the middle roller 54 (which is positioned diametrically opposite the pivot 48) extends slightly inward from the seat 44 further than the other two rollers. In this manner, only the middle roller 54 contacts the operating member 50 unless a relatively large biasing force is needed to prevent direct contact between the seat 44 and the operating member, at which point the other two rollers 54 will contact the operating member.

Of course, any number of rollers 54, any positioning of the rollers, and any type of rolling contact elements may be used in keeping with the principles of the invention.

Figure 8:
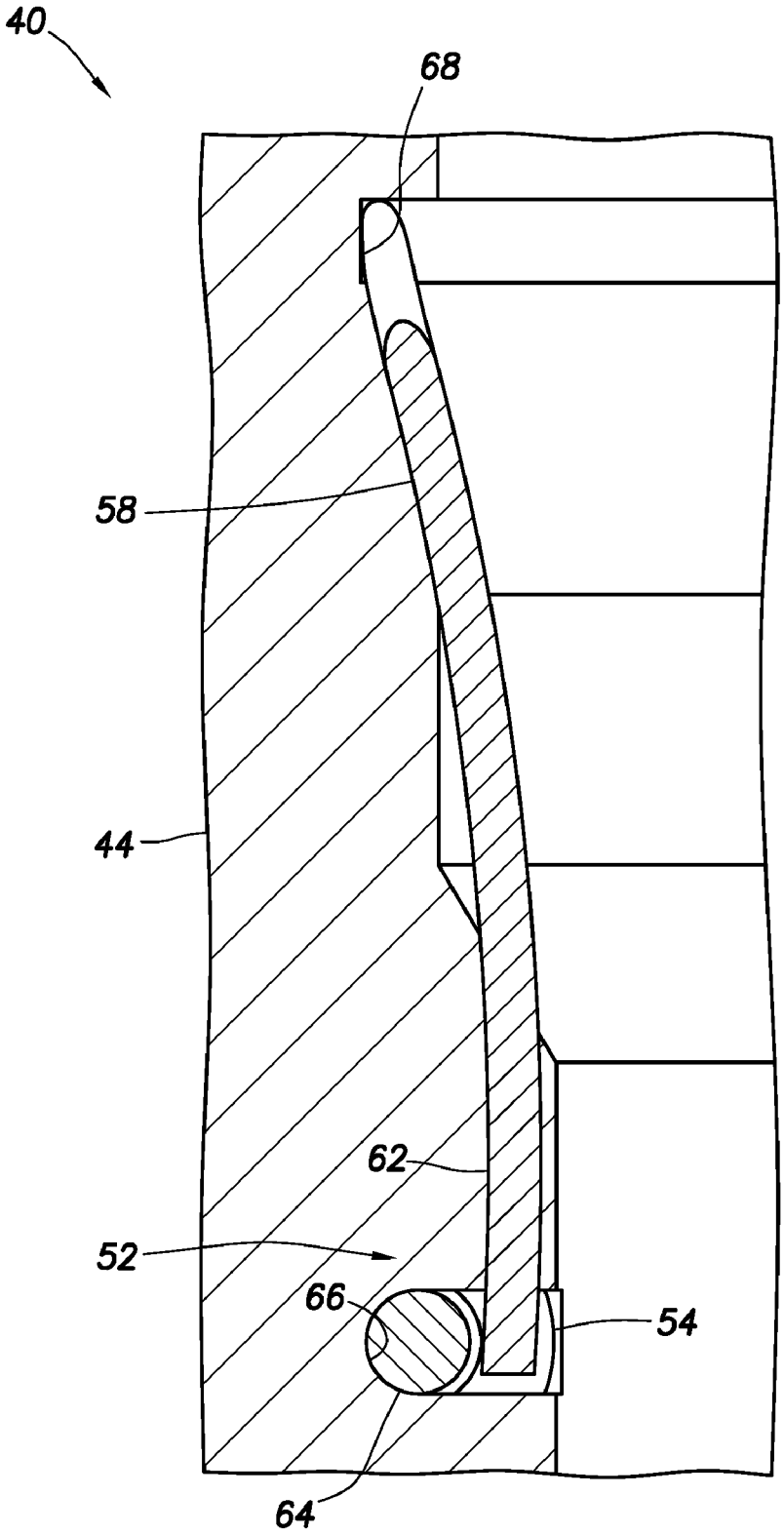
FIG. 8 is an enlarged scale cross-sectional view of a retainer as used in the safety valve of FIG. 6.

Referring additionally now to FIG. 8, an enlarged scale cross-sectional view of one of the rollers 54 is representatively illustrated. In this view, the manner in which the retaining clip 58 is used to secure the roller 54 in the seat 44 may be more clearly seen.

Preferably, the clip 58 includes two legs 62 which straddle the roller 54. In this manner, an axle 64 which extends outwardly from each side of the roller 54 is retained in recesses 66 formed in the interior of the seat 44.

An upper end of the clip 58 is received in a circumferential recess 68 formed in the interior of the seat 44. A curved shape of the clip 58 prevents the upper end of the clip from being dislodged from the recess 68 until the clip 58 is bent inward in order to remove it from the seat 44. Other types and shapes of retainers may be used in place of the clip 58 (such as roll pins, etc.) if desired.

It may now be fully appreciated that the configurations of the safety valve 40 described above provide significant improvements in the art. The safety valve 40 has reduced friction between the operating member 50 and the closure assembly 42.

Note that any of the features of the configurations of the safety valve 40 may be used in combination with the features of any of the other configurations. For example, a safety valve could include one or more friction reducing devices 52 attached to the operating member 50 as depicted in FIG. 4, and also include one or more friction reducing devices in the seat 44 as depicted in FIG. 6.

Thus has been described the safety valve 40 which includes the closure assembly 42 and the operating member 50 which engages the closure assembly. At least one of the closure assembly 42 and the operating member 50 includes a friction reducing device 52 which provides rolling contact between the closure assembly and the operating member.

The friction reducing device 52 may be attached to the closure assembly 42. For example, the friction reducing device 52 may be attached to the closure member 46 of the closure assembly 42. The closure member 46 may be a flapper which pivots to selectively open and close the passage 22 formed through the safety valve 40.

The friction reducing device 52 may be attached to the seat 44 of the closure assembly 42. The operating member 50 may be positioned in an interior of the seat 44, and the friction reducing device 52 may include multiple rollers 54 which extend into the interior of the seat. The rollers 54 may be radially spaced apart from each other by approximately forty-five degrees. The rollers 54 may be positioned on the seat 44 generally diametrically opposite from the pivot 48 of the closure assembly 42.

The friction reducing device 52 may be attached to the operating member 50. The friction reducing device 52 may include one or more rollers 54 attached to one or more of the closure assembly 42 and the operating member 50.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A safety valve for use in a subterranean well, the safety valve comprising:

a closure assembly including a closure member and a closure seat, wherein sealing engagement between the closure member and the closure seat blocks fluid flow through the safety valve in at least one direction;

an operating member which displaces the closure member; and at least one of the closure member, the closure seat, and the operating member including a friction reducing device which provides rolling contact between the operating member and at least one of the closure member and the closure seat.

2. The safety valve of claim 1, wherein the friction reducing device is attached to the closure member.

3. The safety valve of claim 2, wherein the friction reducing device comprises a roller attached to the closure member of the closure assembly.

4. The safety valve of claim 2, wherein the closure member comprises a flapper which pivots to selectively open and close a passage formed through the safety valve.

5. The safety valve of claim 1, wherein the friction reducing device is attached to the closure seat of the closure assembly.

6. The safety valve of claim 5, wherein the operating member is positioned in an interior of the closure seat, and wherein the friction reducing device includes at least one roller which extends into the interior of the closure seat.

7. The safety valve of claim 6, wherein multiple rollers are radially spaced apart from each other by approximately forty-five degrees.

8. The safety valve of claim 1, wherein the friction reducing device is attached to the operating member.

9. A safety valve for use in a subterranean well, the safety valve comprising:

a closure assembly;

an operating member which engages the closure assembly; and at least one of the closure assembly and the operating member including a friction reducing device which provides rolling contact between the closure assembly and the operating member, wherein the friction reducing device is attached to the closure assembly, the friction reducing device is attached to a seat of the closure assembly, the operating member is positioned in an interior of the seat, the friction reducing device includes at least one roller which extends into the interior of the seat, and wherein the roller is positioned on the closure seat generally diametrically opposite from a pivot of a flapper of the closure assembly.

10. A safety valve for use in a subterranean well, the safety valve comprising:

a closure assembly including a closure member and a closure seat;

an operating member which displaces the closure member; and at least one of the closure member, the closure seat, and the operating member including a friction reducing device which provides rolling contact between the operating member and at least one of the closure member and the closure seat, wherein the friction reducing device is attached to the operating member, and wherein the friction reducing device comprises a roller and the operating member comprises a flow tube.

11. A safety valve for use in a subterranean well, the safety valve comprising:

a flapper which rotates about a pivot relative to a seat;

a flow tube which engages the flapper to rotate the flapper; and a friction reducing device which with rolling contact radially biases the flow tube toward the pivot when the flow tube engages the flapper.

12. The safety valve of claim 11, wherein the friction reducing device includes at least one roller attached to one of the seat and the flow tube.

13. A safety valve for use in a subterranean well, the safety valve comprising:

a flapper which rotates about a pivot relative to a seat;

a flow tube which engages the flapper to rotate the flapper; and a friction reducing device which with rolling contact radially biases the flow tube toward the pivot when the flow tube engages the flapper, wherein the friction reducing device is attached to the seat.

14. The safety valve of claim 13, wherein the friction reducing device contacts the flow tube in an interior of the seat.

15. A safety valve for use in a subterranean well, the safety valve comprising:

a flapper which rotates about a pivot relative to a seat;

a flow tube which engages the flapper to rotate the flapper; and a friction reducing device which with rolling contact radially biases the flow tube toward the pivot when the flow tube engages the flapper, wherein the friction reducing device includes at least one roller which extends into the interior of the seat.

16. A safety valve for use in a subterranean well, the safety valve comprising:

a flapper which rotates about a pivot relative to a seat;

a flow tube which engages the flapper to rotate the flapper; and a friction reducing device which with rolling contact biases the flow tube toward the pivot when the flow tube engages the flapper, wherein the friction reducing device includes at least one roller which extends into the interior of the seat, and wherein multiple rollers are radially spaced apart from each other by approximately forty-five degrees.

17. A safety valve for use in a subterranean well, the safety valve comprising:

a flapper which rotates about a pivot relative to a flapper seat;

a flow tube which engages the flapper to rotate the flapper; and at least one of the flapper, the flapper seat and the flow tube having a friction reducing device attached thereto which provides rolling contact between the flow tube and at least one of the flapper and the flapper seat.

18. The safety valve of claim 17, wherein the friction reducing device biases the flow tube toward the pivot when the flow tube engages the flapper.

19. The safety valve of claim 17, wherein the friction reducing device includes at least one roller attached to the flapper seat.

20. The safety valve of claim 17, wherein the friction reducing device includes at least one roller attached to the flow tube.

21. A safety valve for use in a subterranean well, the safety valve comprising:

a flapper which rotates about a pivot relative to a seat;

a flow tube which engages the flapper to rotate the flapper; and at least one of the flapper, the seat and the flow tube having a friction reducing device attached thereto which provides rolling contact between the flapper and the flow tube, or between the flow tube and the seat, wherein the friction reducing device includes at least one roller attached to the flapper.

* * * * *